US005095339A

United States Patent [19]

Terashima

[11] Patent Number: 5,095,339

[45] Date of Patent: Mar. 10, 1992

[54] DEVELOPING APPARATUS

[75] Inventor: Isamu Terashima, Hitachi, Japan

[73] Assignee: Hitachi, Ltd., Tokyo, Japan

[21] Appl. No.: 301,896

[22] Filed: Jan. 25, 1989

[30] Foreign Application Priority Data

Jan. 27, 1988 [JP] Japan ..... 63-14571

[51] Int. Cl.[5] ..... G03G 15/09; G03G 15/08

[52] U.S. Cl. ..... 355/251; 118/656; 355/246; 355/250; 355/253

[58] Field of Search ..... 355/246, 253, 250, 251, 355/245; 118/657, 656; 222/DIG. 1

[56] References Cited

U.S. PATENT DOCUMENTS

| | | | |
|---|---|---|---|
| Re. 29,632 | 5/1978 | Tanaka et al. | 355/251 |
| 3,572,922 | 3/1971 | Olden | 355/253 |
| 4,147,127 | 4/1979 | Terashima | 118/658 X |
| 4,230,070 | 10/1980 | Murasaki et al. | 118/657 X |
| 4,241,696 | 12/1980 | Huzii | 222/DIG. 1 |
| 4,284,702 | 8/1981 | Tabuchi et al. | 430/122 |
| 4,321,886 | 3/1982 | Azuma | 355/246 X |
| 4,331,757 | 5/1982 | Tanaka et al. | 355/253 X |
| 4,347,299 | 8/1982 | Ozawa et al. | 355/246 X |
| 4,485,760 | 12/1984 | Tanaka et al. | 118/657 |
| 4,538,897 | 9/1985 | Osaka et al. | 355/246 |
| 4,615,606 | 10/1986 | Nishikawa et al. | 118/657 X |
| 4,733,267 | 3/1988 | Enoki et al. | 355/253 |
| 4,764,841 | 8/1988 | Brewington et al. | 118/658 X |
| 4,786,936 | 11/1988 | Ikegawa et al. | 355/253 |
| 4,809,034 | 2/1989 | Murasaki et al. | 355/253 |

FOREIGN PATENT DOCUMENTS

| | | |
|---|---|---|
| 0049437 | 4/1978 | Japan . |
| 00107850 | 9/1978 | Japan . |
| 0246081 | 10/1982 | Japan . |
| 0266567 | 11/1987 | Japan . |

*Primary Examiner*—A. T. Grimley
*Assistant Examiner*—Matthew S. Smith
*Attorney, Agent, or Firm*—Antonelli, Terry, Stout & Kraus

[57] ABSTRACT

A developing apparatus operates to develop an electrostatic latent image by using developer which is a mixture of carrier particles and toner particles. Upon detecting a fall in the toner concentration in the developer, a toner supply device supplies stored toner particles to the developer. The supplied toner particles are mixed, by stirring, with the developer by a stirring device. The toner supply device includes a supply roller covered by a short texture or a porous elastic material having a predetermined high resistivity in contact with a circulation current of developer, and a bias power source which applies a bias voltage between the supply roller and the circulation current of developer such that the supply roller and the supplied toner particles have the same voltage polarity.

8 Claims, 1 Drawing Sheet

DEVELOPING APPARATUS

BACKGROUND OF THE INVENTION

This invention relates to a developing apparatus, and particularly to a toner supply device, used in a developing apparatus, for supplying toner particles to a developer which is a mixture of carrier particles and toner particles.

A copy machine or printer utilizing electric photography has its developing unit including means of supplying toner to a developer which consists of a mixture of carrier particles and toner particles. The toner supply means operates to supply toner particles to the developer so that the toner concentration in the developer is maintained within the specified range. The toner supply means drops toner particles stored in the toner container into the developer container, or supplies toner particles to the developer magnetic brush while metering it in the recess on the supply roller surface during the transportation.

Such developing apparatuses as mentioned above are described in U.S. Pat. Nos. 4,147,127 and 4,284,702.

However, these conventional apparatuses merely place stored toner particles on the developer surface, and, in this manner, supplied toner particles weakly adhere to carrier particles in developer.

Toner particles have an extremely small specific gravity as compared with carrier particles, and therefore toner particles may float on the developer surface instead of mixing with developer. Toner particles floating on the developer do not easily sediment, and it takes a long time before supplied toner mixes with the developer and the toner concentration in the developer rises, resulting in an inferior response and in the difficulty in accurate toner concentration control. Other problems involved are an increased quantity of toner particles dispersed into the air, and a shortened life of the developer when it is stirred more powerfully with the intention of speeding up the mixing of supplied toner particles.

On the other hand, for simplicity of the developer stirring device, for example, the toner supply roller is arranged in contact with the magnetic brush, with a bias voltage being applied thereto, as disclosed in Japanese Patent Unexamined Publication (JP-A) 62-246081. In this developing device, the magnetic brush supplied with the toner particles is immediately used for developing an electrostatic latent image in a succeeding step. The magnetic brush (developer) supplied with the toner particles is to be used for development without being sufficiently stirred, and hence nonuniformity of a supplied amount of toner particles appears in the form of development irregularity. Such irregularity is easily seen in the developing device of this type as compared with the developing device of the type in which the developer supplied with the toner particles is returned to the container and then stirred therein. In order to obtain the image having no development irregularity, the toner supply device needs high control accuracy with which high uniformity of the toner supply is realized. The developing device of this type has such a problem and is not practical in use.

SUMMARY OF THE INVENTION

It is a first object of this invention to provide a toner supply means for a developing apparatus, in which supplied toner adheres to carrier particles in a developer instead of separating from it and without the need of an increased stirring force for mixing.

A second object of this invention is to provide a toner supply means for a developing apparatus based on the magnetic brush development system, in which supplied toner particles adhere to carrier particles in a developer immediately.

A third object of this invention is to provide a toner supply means, for a developing apparatus, which is suited to achieve the above first and second objects.

The first object is accomplished by a developing apparatus including a developer container containing a developer which is a mixture of carrier particles and toner particles, means of developing an electrostatic latent image using the developer in the developer container, toner supply means which detects a fall in the toner concentration in the developer to supply toner to the developer, and stirring means which mixes, by stirring, toner particles supplied by the toner supply means with the developer in the developer container, wherein the toner supply means comprises means of creating a circulation current of developer, a supply roller which holds supplied toner dispersing on its surface, with the holding surface being in contact with the developer circulation current, and a bias voltage source which applies a bias voltage between the supply roller and the developer circulation current so that the supply roller has the same polarity of voltage as the supplied toner particles.

The second object is accomplished by a developing apparatus based on the magnetic brush development system, which uses a developer circulation current created by a magnetic roll, which forms a developer magnetic brush, for magnetically adhering developer in the developer container for developing an electrostatic latent image and developer removal means which takes developer off the magnetic roll and returns it to the developer container.

According to this invention, the supply roller has its conductive roller surface covered with short texture or porous elastic material having a resistivity of $10^8$–$10^{11}$ $\Omega$/cm.

When the supply roller surface is in contact with the developer circulation current, supplied toner particles held in dispersion on the supply roller surface are attracted by carrier particles in the developer and adhere to them by the effect of the bias electric field. Accordingly, toner particles supplied to the developer are mixed promptly.

In the magnetic brush development system, the magnetic roll and developer removal means provide a developer circulation current suitable for supplying toner particles. The short texture or porous elastic material which covers the surface of the conductive roller forms a supply roller surface which is effective for holding toner particles in dispersed fashion.

According to this invention, as described, supplied toner particles can be mixed with the developer immediately without the need of an increased stirring force for mixing, whereby accurate toner concentration control is made possible without sacrificing the life of developer and the quantity of toner particle dispersion into the air can be reduced.

For a developing apparatus based on the magnetic brush development system, the use of the developer circulation current for developing an electrostatic latent image simplifies the structure, and a supply roller suitable for supplying toner particles to the developer circulation current is offered.

DESCRIPTION OF THE PREFERRED EMBODIMENTS

Figure 1:
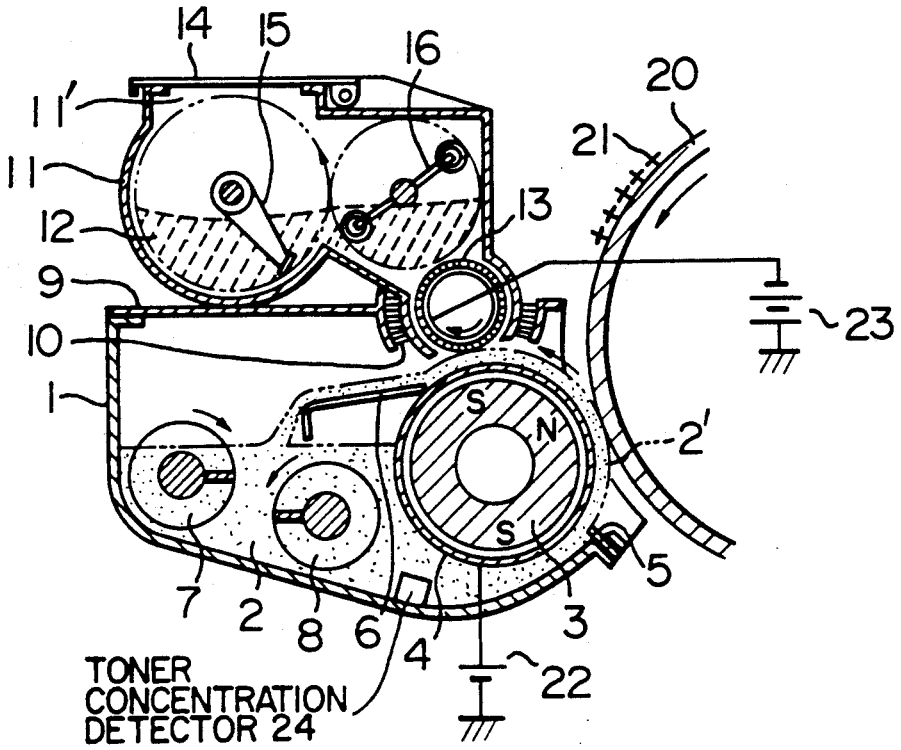
FIG. 1 is a side cross-sectional view of the developing apparatus according to the invention.

In FIG. 1, a developer container 1 contains developer 2 which is a mixture of magnetic carrier particles and nonmagnetic toner particles. A fixed cylinder magnet 3 and a nonmagnetic conductive sleeve 4 which rotates in the direction shown by the arrow constitute a magnetic roller, with its surface forming a developer magnetic brush 2' by attracting developer 2 magnetically. The developer magnetic brush 2' has its bristle height limited by a limiting plate 5, and a photosensitive drum 20 is wiped by the bristle tip so that an electrostatic latent image 21 is developed. A developing bias voltage source 22 is connected to the sleeve 4 so that a developing bias voltage is applied to the developer magnetic brush 2'.

A developer removing plate 6 removes the developer magnetic brush 2' off the sleeve 4 after development has been completed, so that developer 2 which constitutes the magnetic brush 2' is returned to the developer container 1. The developer 2 returned into the developer container 1 is stirred and mixed by stirring screws 7 and 8, and attracted by the magnetic roller to form the developer magnetic brush 2' again.

A developer container cover 9 is provided thereon, in hermetic coupling by a furred seal 10, with a toner supply hopper case 11, in which is contained supply toner particles 12 fed through a hatch 11' having a door 14. A first stirring arm 15 serves to prevent stored toner particles 12 from solidifying and also to transport stored toner particles from the left chamber to the right chamber in the hopper case 11. A second stirring arm 16 serves to prevent the creation of a toner bridge so that stored toner particles 12 are fed to a supply roller 13 smoothly.

Figure 2:
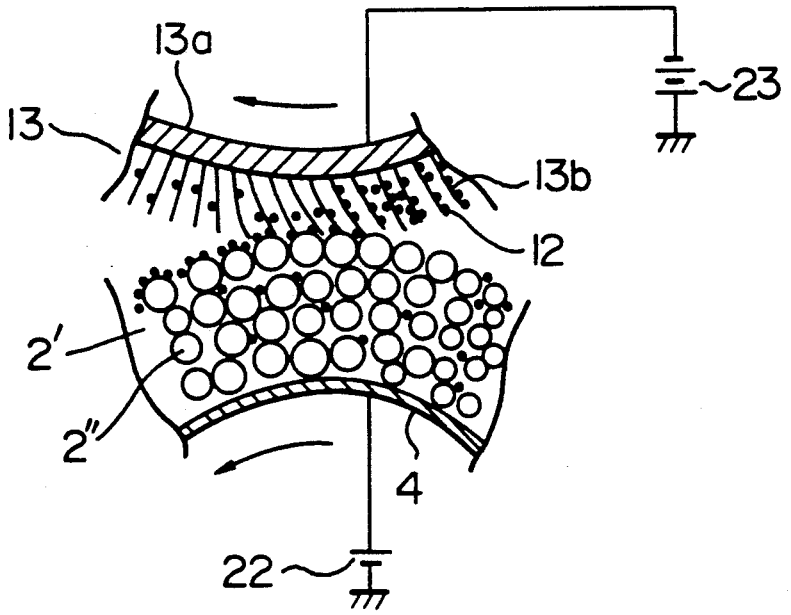
FIG. 2 is an enlarged side cross-sectional view showing in part the apparatus of FIG. 1.

The supply roller 13 is formed of a conductive cylinder 13*a* covered on its surface by a short texture 13*b* of high-resistivity material ($10^8$–$10^{11}$ Ω/cm), and the stored toner particles 12 adhere distributively on the surface of the short texture, as shown in FIG. 2. The stored toner particles 12 are charged to a negative voltage in the manufacturing process, transportation and stirring in the hopper case 11. The bias voltage source 23 is connected to the conductive cylinder 13*a* so that the cylinder 13*a* has a negative (the same polarity as the stored toner particles 12) voltage of 300–600 volts relative to the sleeve 4 of developing magnetic roller. The reason for the provision of the high-resistivity material of $10^8$–$10^{11}$ Ω/cm for the short texture 13*b* is to prevent excessive discharging by the bias voltage and to prevent frictional charging.

The supply roller 13 is located so that the short texture 13*b* is in weak contact with the surface of the developer magnetic brush 2', and rotated in the same direction as the developer magnetic brush 2' when toner is supplied.

As the development process is carried out repeatedly, the toner concentration in the developer falls. Upon detecting a fall of toner concentration to a specified level by a toner concentration detector 24, rotation of the supply roller 13 is started. Consequently, the supply roller 13 rotates, with its short texture 13*b* being in weak contact with the surface of the developer magnetic brush 2'. The surface of the short texture 13*b* has a distributive adhesion of stored toner particles 12 when it rotates in the hopper case 11. With the short texture 13*b* being in contact with the developer magnetic brush 2', supplied toner particles 12 on the texture surface are attracted electrostatically to the surface of carrier particles 2" by the effect of the electric field produced by the bias voltage.

According to the foregoing toner particles supply device, supplied toner particles 12 are mixed with developer 2 immediately, and thereafter are dispersed evenly in the developer 2 by the operation of the stirring screws 7 and 8, and rendered frictional charges to the saturation in the same state as the existing toner particles. As a result, supplied toner particles are prevented from balling and floating on developer 2, as is the case of the conventional device.

The foregoing toner supply means utilizes the circulation current of developer 2 created by the developer magnetic brush 2' formed on the magnetic roll surface, and is designed to supply stored toner particles 12 to the circulation current. Alternatively, stored toner particles 12 may be supplied to a developer circulation current created separately thereby to accomplish toner supply.

The surface of the supply roller 13 for holding supplied toner particles 12 distributively may be covered by a porous elastic material with the same electrical characteristics, in place of the short texture 13*b*.

I claim:

1. A developing apparatus comprising:

a developer container for containing developer which consists of a mixture of carrier particles and toner particles;

means for developing an electrostatic latent image by using the developer in said developer container;

toner supply means for detecting a fall in the toner concentration in the developer and supplying stored toner particles to the developer; and stirring means for mixing evently the toner particles supplied by said toner supply means with the developer in said developer container and stirring the mixture;

said toner supply means comprising:

means for creating a circulation current of developer;

a supply roller for holding on the surface thereof the supplied toner particles distributely, with said toner particles holding surface being in contact with said circulation current of developer; and a bias voltage source for applying a bias voltage between said supply roller and said circulation current of developer such that said supply roller and the supplied toner particles have a same voltage polarity;

wherein said supply roller includes an electrical conductive surface which is covered by a short texture having a resistivity of $10^8$–$10^{11}$ Ω/cm, and wherein said supplied toner particles adhere on the surface of said short texture, with said bias voltage being applied to said conductive surface.

2. A developing apparatus comprising:

a developer container for containing developer which consists of a mixture of carrier particles and toner particles;

means for developing an electrostatic latent image by using the developer in said developer container;

toner supply means for detecting a fall in the toner concentration in the developer and supplying stored toner particles to the developer; and stirring means for mixing evenly the toner particles supplied by said toner supply means with the developer in said developer container and stirring the mixture;

said toner supply means comprising:

means for creating a circulation current of developer;

a supply roller for holding on the surface thereof the supplied toner particles distributively, with said toner particles holding surface being in contact with said circulation current of developer; and a bias voltage source for applying a bias voltage between said supply roller and said circulation current of developer such that said supply roller and the supplied toner particles have a same voltage polarity;

wherein said supply roller includes an electrical conductive surface which is covered by a porous elastic material having a resistivity of $10^8$–$10^{11}$ Ω/cm, and wherein said supplied toner particles adhere on the surface of said porous elastic material, with said bias voltage being applied to said conductive surface.

3. A developing apparatus comprising:

a developer container for containing developer which consists of a mixture of carrier particles and toner particles, a magnetic roller for forming a developer magnetic brush by adhering on the surface thereof the developer in said developer container magnetically, said developer magnetic brush operating to develop an electrostatic latent image;

developer removal means for removing developer from said magnetic roller and for returning the removed developer to said developer container, thereby creating a circulation current of developer;

toner supply means for detecting a fall in the toner concentration in the developer and supplying stored toner particles to the developer; and stirring means for mixing evenly the toner particles supplied by said toner supply means with the developer in said developer container and stirring the mixture;

said toner supply means comprising:

a supply roller for holding on the surface thereof the supplied toner particles distributively, with said toner particles holding surface being in contact with said circulation current of developer; and a bias voltage source for applying a bias voltage between said supply roller and said circulation current of developer such that said supply roller and the supplied toner particles have a same voltage polarity;

wherein said supply roller includes an electrical conductive surface which is covered by a short texture having a resistivity of $10^8 10^{11}$ Ω/cm, and wherein said supplied toner particles adhere on the surface of said short texture, with said bias voltage being applied to said conductive surface.

4. A developing apparatus comprising:

a developer container for containing developer which consists of a mixture of carrier particles and toner particles;

a magnetic roller for forming a developer magnetic brush by adhering on the surface thereof the developer in said developer container magnetically, said developer magnetic brush operating to develop an electrostatic latent image;

developer removal means for removing developer from said magnetic roller and for returning the removed developer to said developer container, thereby creating a circulation current of developer;

toner supply means for detecting a fall in the toner concentration in the developer and supplying stored toner particles to the developer; and stirring means for mixing evenly the toner particles supplied by said toner supply means with the developer in said developer container and stirring the mixture;

said toner supply means comprising:

a supply roller for holding on the surface thereof the supplied toner particles distributively, with said toner particles holding surface being in contact with said circulation current of developer; and a bias voltage source for applying a bias voltage between said supply roller and said circulation current of developer such that said supply roller and the supplied toner particles have a same voltage polarity;

wherein said supply roller includes an electrical conductive surface which is covered by a porous elastic material having a resistivity of $10^8$–$10^{11}$ Ω/cm, and wherein said supplied toner particles adhere on the surface of said porous elastic material, with said bias voltage being applied to said conductive surface.

5. A developing apparatus comprising:

a developing container for containing developer which consists of a mixture of carrier particles and toner particles;

means for developing an electrostatic latent image by using the developer in said developing container;

toner supply means for detecting a fall in the toner concentration in the developer and supplying stored toner particles to the developer; and stirring means for mixing evenly the toner particles supplied by said toner supply means with the developer in said developing container and stirring the mixture;

said toner supply means comprising:

means for creating a circulation current of developer;

a supply roller having an electrical conductive surface covered by a short texture having a resistivity of $10^8$–$10^{11}$ Ω/cm in contact with said circulation current of developer, said short texture holding, by adhesion, the supplied toner particles distributively; and a bias voltage source for applying a bias voltage between said supply roller and said circulation current of developer such that said supply roller and the supplied toner particles have a same voltage polarity.

6. A developing apparatus comprising:

a developing container for containing developer which consists of a mixture of carrier particles and toner particles;

means for developing an electrostatic latent image by using the developer in said developing container;

toner supply means for detecting a fall in the toner concentration in the developer and supplying stored toner particles to the developer; and stirring means for mixing evenly the toner particles supplied by said toner supply means with the developer in said developing container and stirring the mixture;

said toner supply means comprising:

means for creating a circulation current of developer;

a supply roller having an electrical conductive surface covered by a porous elastic material having a resistivity of $10^8$–$10^{11}$ Ω/cm in contact with said circulation current of developer, said porous elastic material holding, by adhesion, the supplied toner particles distributively; and a bias voltage source for applying a bias voltage between said supply roller and said circulation current of developer such that said supply roller and the supplied toner particles have a same voltage polarity.

7. A developing apparatus comprising:

a developing container for containing developer which consists of a mixture of carrier particles and toner particles;

a magnetic roller for forming a developer magnetic brush by adhering on the surface thereof the developer in said developing container magnetically, said developer magnetic brush operating to develop an electrostatic latent image;

developer removal means for removing developer from said magnetic roller and returning the removed developer to said developing container, thereby creating a circulation current of developer;

toner supply means for detecting a fall in the toner concentration in the developer and supplying stored toner particles to the developer in said developing container; and stirring means for mixing evenly the toner particles supplied by said toner supply means with the developer in said developing container and stirring the mixture;

said toner supply means comprising:

a supply roller having an electrical conductive surface covered by a short texture having a resistivity of $10^8$–$10^{11}$ Ω/cm in contact with said circulation current of developer, said short texture holding, by adhesion, the supplied toner particles distributively; and a bias voltage source for applying a bias voltage between said supply roller and said circulation current of developer such that said supply roller and the supplied toner particles have a same voltage polarity.

8. A developing apparatus comprising:

a developing container for containing developer which consists of a mixture of carrier particles and toner particles;

a magnetic roller for forming a developer magnetic brush by adhering on the surface thereof the developer in said developing container magnetically, said developer magnetic brush operating to develop an electrostatic latent image;

developer removal means for removing developer from said magnetic roller and returning the removed developer to said developing container, thereby creating a circulation current of developer;

toner supply means for detecting a fall in the toner concentration in the developer and supplying stored toner particles to the developer in said developing container; and stirring means for mixing evenly the toner particles supplied by said toner supply means with the developer in said developing container and stirring the mixture;

said toner supply means comprising:

a supply roller having an electrical conductive surface covered by a porous elastic material having a resistivity of $10^8$–$10^{11}$ Ω/cm in contact with said circulation current of developer, said porous elastic material holding, by adhesion, the supplied toner particles distributively; and a bias voltage source for applying a bias voltage between said supply roller and said circulation current of developer such that said supply roller and the supplied toner particles have a same voltage polarity.

* * * * *